United States Patent [19]

Sinn et al.

[11] 4,017,651

[45] Apr. 12, 1977

[54] PRE-TREATMENT OF NON-WOVENS

[75] Inventors: Gustav Sinn, Opladen; Martin Matner, Odenthal, both of Germany

[73] Assignee: Bayer Aktiengesellschaft, Germany

[22] Filed: Mar. 25, 1975

[21] Appl. No.: 561,936

[30] Foreign Application Priority Data

Mar. 30, 1974 Germany ..... 2415602

[52] U.S. Cl. ..... 427/55; 427/189; 427/195; 427/246; 427/390 R

[51] Int. Cl.[2] ..... B05D 3/02; D06B 1/00

[58] Field of Search ..... 427/55, 246, 390 R, 427/195, 189

[56] References Cited

UNITED STATES PATENTS

| | | | |
|---|---|---|---|
| 3,137,589 | 6/1964 | Reinhard et al. | 427/390 R X |
| 3,407,164 | 10/1968 | Schmidt | 427/390 R X |
| 3,811,923 | 5/1974 | Hammer et al. | 427/246 X |

*Primary Examiner*—James R. Hoffman
*Attorney, Agent, or Firm*—Connolly and Hutz

[57] ABSTRACT

Process for pre-strengthening a non-woven textile fibre fleece obtained by the wet process wherein a heat-sensitive latex mixture whose coagulation point does not substantially change on dilution is applied in a finely divided form to the surface of the wet fleece and the fleece is then heated to a temperature at which the latex mixture coagulates to form a gel-like film.

12 Claims, No Drawings

PRE-TREATMENT OF NON-WOVENS

Bonded textile fiber fleeces (non-woven textiles) are normally made by first producing the dry textile fiber fleece, then impregnating it with a synthetic resin latex or rubber latex and subsequently precipitating the synthetic resin or rubber.

Textile fiber fleeces can be obtained by carding textile fibers and laying them out into a fleece or by homogeneously mixing the fibers and blowing them against a sieve to deposit a fleece.

This process can only produce fleeces at the rate of 1 — 2 m per minute. Non-woven textile fleeces may be produced much more rapidly by a wet process similar to that employed for the manufacture of paper. The cellulose fibers used for the manufacture of paper become welded together even while the web is being produced so that the web is sufficiently firm even in the wet state and may be lifted from its support. Textile fibers, on the other hand, do not weld. Fiber fleeches produced by a method similar to that used in paper manufacture therefore have no coherence and cannot be lifted from their support. They are therefore impossible to impregnate, and even after drying in the support the fleece is not firm enough for subsequent impregnation.

Attempts have been made to add synthetic resin or rubber latices to the fiber pulp, i.e. to the suspension of fibers in water, and subsequently to coagulate the latices, or to add precoagulated latices initially. Even this method does not result in a fleece which may be impregnated in the wet state.

This invention relates to a process for pre-strengthening a textile fiber fleece obtained by the wet process, wherein a heat-sensitive polymer latex mixture, whose coagulation temperature does not alter substantially on dilution, is applied in a finely divided form to the surface of a wet fiber fleece and the fleece is then heated to a temperature at which the polymer latex mixture coagulates to form a gel-like polymer film.

The heat-sensitive polymer latex mixture is generally sprayed directly onto the fleece after most of the water in the pulp has been removed mechanically. The simplest method of heating the fleece to the necessary coagulation temperature is to expose it to infra-red radiant heat.

After this heat-treatment, the fleece is sufficiently strengthened by the gel-like polymer film so that most of the water still contained in it may be squeezed out mechanically. The fleece can then be lifted from its support without damage and impregnated without an intermediate drying stage.

Heat-sensitive polymer latex mixtures of a given concentration generally have a well defined coagulation temperature. This temperature, however, depends on the concentration and increases with decreasing latex concentration. In the present case, the latex is applied to a wet fleece and thereby considerably diluted. Therefore heat-sensitive polymer latex mixtures have to be used whose coagulation temperature is substantially independent of their concentration.

Heat-sensitive latex mixtures are known. Most of them are based on latices of natural or synthetic rubber, e.g. rubbers which contain carboxylic groups, such as copolymers of one or more ethylenically unsaturated monomers with acrylic acid and/or methacrylic acid which contain from 1 to 6%, by weight, of carboxyl groups.

In particular, ethylenically unsaturated monomers include: butadiene, chloroprene, acrylonitrile, styrene, acrylic and methacrylic acid alkyl esters containing from 1 to 6 carbon atoms in the alkyl group (e.g. ethyl acrylate, methyl methacrylate) or mixtures thereof.

Acrylamide, methacrylamide and acrylamido methylol ether may be used as additional monomers.

Copolymers of butadiene, acrylonitrile and methacrylic acid and copolymers of acrylic acid esters and methacrylic acid are preferred.

They may also contain a heat-sensitising agent, e.g. a functional silane (see German Pat. No. 1,268,828), in addition to emulsifiers. The coagulation temperatures of such heat-sensitive latex mixtures are dependent on the concentration. In order to obtain heat-sensitive latex mixtures which have coagulation temperatures substantially independent of the concentration, the quantity of sensitising agent must be increased until the latex is only just stable at 20° C and an additional stabiliser must then be added which is ineffective at a higher temperature. Additional stabilisers of this type include, e.g. ethoxylated long-chain alcohols, acids and phenols, in particular ethoxylated phenyl phenols and ethoxylated alkanols which contain from 8 to 18 carbon atoms and from 8 to 20 ethoxy units.

Combinations of ethoxylated phenols and ethoxylated alkanols are particularly preferred. The quantity of heat-sensitising agent in the latex is generally from 0.5 to 8, preferably from 1 to 5, parts, by weight, per 100 parts, by weight, of latex solids. The additional stabilisers are generally used in quantities of from 0.8 to 6 parts, by weight, per 100 parts, by weight, of latex solids.

In this way the coagulation temperature is kept constant even when the concentration is reduced since coagulation sets in only when the additional stabiliser becomes ineffective and the increased quantity of sensitiser ensures that, even after dilution, the concentration of sensitiser is still sufficient to be effective.

The heat-sensitive latex mixtures may contain melamine/formaldehyde resin precondensates as additional additives (e.g. from 1 to 10% by weight, based on the solids content) and water-soluble inorganic salts, such as $MgCl_2$, $Al_2(SO_4)_3$, or $NH_4Cl$ (in quantities of up to 1% by weight, based on the solids content of the latex).

Any non-woven textile fiber fleece may, in principle, be subjected to the process of the invention but fleece of a fiber mixture consisting of polyamide, polyester, rayon staple or polyacrylonitrile are preferred. It is particularly preferred to use fibers in a crimped form.

The quantity of heat-sensitive latex applied is calculated so that after coagulation of the latex the fleece contains from 1 to 50% of rubber, based on the dry fiber weight. The coagulation points are generally from 30° to 70° C.

EXAMPLE

A mixture of 40% of polyamide fibers (2.2 dtex/6 mm), 40% of polyamide fibers (2.2 dtex/12 mm), 10% of viscose (3.3 dtex/10 mm) and 10% of viscose (1.7 dtex/6 mm) is suspended in about 20-times its weight of water. A web is produced from this pulp in a conventional continuously operating paper making machine (hydroformer). The major quantity of water is sieved-off and sucked-off. The web obtained in this way weighs 280 g/m² and has a water content of 300%, based on the weight of fibers. 20 g/m² of a dispersion with a solids content of about 50% of the following composition is then sprayed on to the web:

200.0 parts, by weight, of a 50% latex of a copolymer of 60 parts, by weight, of butadiene, 36 parts, by weight, of acrylonitrile and 4 parts, by weight, of methacrylic acid;

10.0 parts, by weight, of a 20% solution of ethoxylated phenyl phenol having 14 ethoxyl groups in water;

10.0 parts, by weight, of a 20% solution of an ethoxylated cetyl alcohol having 14 ethoxyl groups in water;

1.0 part, by weight, of 30% ammonia solution;

6.0 parts, by weight, of a 55% aqueous melamine/formaldehyde precondensate solution;

3.0 parts, by weight, of an ethoxylated polysiloxane of the formula: $[CH_3SiO_3][(CH_3)_2SiO]_{20}([C_2H_4O]_{4.3}[C_3H_6O]_3C_4H_9)_3$; and 5.0 parts, by weight, of 10% aqueous magnesium chloride solution.

The coagulation point of the mixture is 36° C, at the given concentration and about 40° C when the mixture is diluted with twice the quantity of water.

The fleece is then exposed to infra-red radiation of 20 kwh for 5 to 10 seconds. The latex is thereby converted into a gel-like film which strengthens the fleece sufficiently to enable it to be removed from the sieve of the machine. The fleece is then ready for the usual bonding process.

We claim:

1. In the wet process of forming a non-woven textile fiber fleece wherein most of the water from an aqueous suspension of textile fibers is mechanically removed to thereby obtain a wet textile fiber fleece, the improvement which comprises applying in finely divided form to the surface of said wet textile fiber fleece a heat-sensitive latex mixture whose coagulation point does not change substantially on dilution and then heating the fleece to a temperature at which the latex mixture coagulates to form a gel-like film.

2. A process as claimed in claim 1 in which the latex mixture is sprayed onto the wet fleece.

3. A process as claimed in claim 1 in which the coagulation is carried out by exposure to infra-red radiant heat.

4. A process as claimed in claim 1 in which the latex mixture comprises a copolymer of butadiene, acrylonitrile and methacrylic acid and/or a copolymer of acrylic acid esters and methacrylic acid.

5. A process as claimed in claim 1 in which the latex mixture comprises at least one heat-sensitising agent and/or emulsifier and/or additional stabiliser.

6. A process as claimed in claim 5 in which the heat-sensitising agent is present in an amount of from 0.5 to 8.0 parts by weight, per 100 parts by weight of latex solids.

7. A process as claimed in claim 6 in which from 1.0 to 5.0 parts of heat-sensitising agent are present.

8. A process as claimed in claim 5 in which the additional stabiliser is present in an amount of from 0.8 to 6.0 parts by weight, per 100 parts by weight of latex solids.

9. A process as claimed in claim 1 in which the fleece comprises polyamide, polyester, rayon staple or polyacrylonitrile.

10. A process as claimed in claim 9 in which the fibers are in crimped form.

11. A process as claimed in claim 1 in which, after coagulation, the fleece contains from 1 to 50%, based on the dry fiber weight, of rubber.

12. A process as claimed in claim 1 in which the coagulation point of the latex mixture is from 30° to 70° C.

* * * * *